US011000447B2

(12) United States Patent
Kokakis

(10) Patent No.: US 11,000,447 B2
(45) Date of Patent: May 11, 2021

(54) PORTABLE MODULAR FITNESS SYSTEM

(71) Applicant: Koka Co., LLC, Panora, IA (US)

(72) Inventor: Anthony Spiro Kokakis, Panora, IA (US)

(73) Assignee: Koka Co., LLC, Panora, IA (US)

( * ) Notice: Subject to any disclaimer, the term of this patent is extended or adjusted under 35 U.S.C. 154(b) by 251 days.

(21) Appl. No.: 15/805,612

(22) Filed: Nov. 7, 2017

(65) Prior Publication Data

US 2018/0125746 A1 May 10, 2018

Related U.S. Application Data

(60) Provisional application No. 62/418,380, filed on Nov. 7, 2016.

(51) Int. Cl.
*A61H 15/00* (2006.01)
*A63B 21/00* (2006.01)
(Continued)

(52) U.S. Cl.
CPC ... *A61H 15/0092* (2013.01); *A63B 21/00065* (2013.01); *A63B 21/0601* (2013.01); *A63B 21/0724* (2013.01); *A63B 21/0726* (2013.01); *A63B 21/4035* (2015.10); *A63B 21/4037* (2015.10); *A63B 21/4043* (2015.10); *A63B 23/12* (2013.01); *A61H 2015/0014* (2013.01); *A61H 2201/0107* (2013.01);
(Continued)

(58) Field of Classification Search
CPC ..... A61H 15/0092; A61H 2201/0161; A61H 2201/1671; A61H 2015/0014; A61H 2201/0107; A61H 2201/0157; A61H 2201/1253; A63B 21/0724; A63B 21/0726; A63B 21/00065; A63B 21/4035; A63B 21/4037; A63B 21/0601; A63B 21/4043; A63B 23/12; A63B 21/0728; A63B 21/075; A63B 21/0557; A63B 2210/50; A63B 2209/10
See application file for complete search history.

(56) References Cited

U.S. PATENT DOCUMENTS 937,225 A * 10/1909 Burr ..... A63B 21/075 482/108
1,015,068 A * 1/1912 Pulit ..... E06B 9/52 160/391
(Continued)

*Primary Examiner* — Garrett K Atkinson
(74) *Attorney, Agent, or Firm* — Brick Gentry Law Firm; Brian J. Laurenzo; Jessica L. Susie

(57) ABSTRACT

Aspects of the present disclosure involve an attachment system that combines a fitness mat to another fitness related accessory. The accessory attachment attaches to a fitness mat but is not limited to such attachment. The fitness accessory attachment may include an apparatus with internal weights. The fitness accessory may have detachable and adjustable handles with a removably adjustable and slidable attachment mechanism. The provided handle caps can be removed for various reasons such as using connecting pieces or adding weight to the interior of the handles. Fitness bands or any training tools available can run through the fitness accessory apparatus' core and connect to the attachment mechanism provided on the handles for training use. This system also provides compaction for travel and ease of portability.

20 Claims, 5 Drawing Sheets

(51) Int. Cl.

| | |
|---|---|
| ***A63B 21/06*** | (2006.01) |
| ***A63B 23/12*** | (2006.01) |
| ***A63B 21/072*** | (2006.01) |
| ***A63B 21/055*** | (2006.01) |
| ***A63B 21/075*** | (2006.01) |

(52) U.S. Cl.

CPC ..... *A61H 2201/0157* (2013.01); *A61H 2201/0161* (2013.01); *A61H 2201/1253* (2013.01); *A61H 2201/1671* (2013.01); *A63B 21/0557* (2013.01); *A63B 21/075* (2013.01); *A63B 21/0728* (2013.01); *A63B 2209/10* (2013.01); *A63B 2210/50* (2013.01)

(56) References Cited

U.S. PATENT DOCUMENTS 1,274,595 A * 8/1918 Ranz ..... A47G 9/10 5/636
1,277,030 A * 8/1918 Berger ..... B27M 3/22 144/354
1,536,048 A * 5/1925 Alastalo ..... A63B 21/075 482/108
1,991,520 A * 2/1935 Postl ..... A63B 21/0728 482/108
2,273,710 A * 2/1942 Klaes ..... A61H 15/0092 601/119
2,501,270 A * 3/1950 Fleming ..... F41C 33/06 206/579
2,943,621 A * 7/1960 Phillips ..... A61H 23/0218 601/57
3,859,742 A * 1/1975 Amaro ..... D06C 3/08 38/102.4
4,076,236 A * 2/1978 Lonel ..... A63B 21/0602 482/106
4,351,526 A * 9/1982 Schwartz ..... A63B 21/0726 482/105
4,430,814 A * 2/1984 Wulc ..... D06C 3/08 101/127.1
4,566,690 A * 1/1986 Schook ..... A63B 21/0728 482/106
5,018,442 A * 5/1991 Hamu ..... B41F 15/36 101/127.1
5,028,030 A * 7/1991 Lewis ..... A47G 1/20 248/493
5,090,693 A * 2/1992 Liang ..... A63B 21/0726 482/108
5,114,012 A * 5/1992 Mushinski ..... B65B 25/148 206/389
5,135,455 A * 8/1992 King ..... A63B 21/0726 482/105
5,143,056 A * 9/1992 Yih-Jong ..... A61H 15/00 601/118
5,291,625 A * 3/1994 Leslie ..... A47C 27/081 5/420
5,335,809 A * 8/1994 Toida ..... A47J 41/0011 220/23.88
5,347,732 A * 9/1994 Padawer ..... D06C 3/08 160/241
5,425,194 A * 6/1995 Miller ..... A01K 97/08 206/315.11
5,475,948 A * 12/1995 Parke ..... E06B 7/2316 49/470
5,554,102 A * 9/1996 Chiou ..... A61H 15/0092 601/118
5,572,757 A * 11/1996 O'Sullivan ..... A47C 7/46 297/284.5
5,637,065 A * 6/1997 Chang ..... A63B 23/14 482/1
5,802,644 A * 9/1998 Scheurer ..... A47G 9/10 5/640
5,930,835 A * 8/1999 Silvestri ..... A63C 11/00 2/16
6,450,333 B1 * 9/2002 McClenahan ..... A01K 97/08 190/104
6,560,932 B2 * 5/2003 Heroux ..... E06B 7/2316 49/467
D497,961 S * 11/2004 Rolfes ..... D21/662
6,939,276 B2 * 9/2005 Gates ..... A63B 21/0606 482/106
7,052,445 B2 * 5/2006 Ekhaus ..... A63B 21/0601 482/108
7,108,646 B1 * 9/2006 Quick ..... A47D 13/08 482/132
7,112,178 B1 * 9/2006 Roozenburg ..... A61H 1/0266 601/121
7,387,599 B1 * 6/2008 Hsu ..... A61H 15/0092 482/122
7,401,439 B2 * 7/2008 Heroux ..... E06B 7/2316 49/470
7,918,774 B2 * 4/2011 Dye ..... A61H 15/0092 482/132
8,075,464 B2 * 12/2011 Hayes ..... A63B 21/4037 482/142
8,556,837 B1 * 10/2013 Poirier ..... A61H 15/0092 601/46
8,662,137 B2 * 3/2014 Bohlen ..... E06B 9/46 160/241
8,701,350 B2 * 4/2014 Vulpitta ..... E06B 7/26 49/470
8,733,019 B2 * 5/2014 Vulpitta ..... E06B 7/2316 49/70
8,784,287 B2 * 7/2014 Miller, Jr. ..... A63B 21/4049 482/132
8,926,482 B2 * 1/2015 Miller, Jr. ..... A63B 21/4049 482/132
8,951,172 B2 * 2/2015 Marcus ..... A63B 21/0608 482/109
9,149,410 B2 * 10/2015 Justice Velasco ..... A63B 22/0089
9,463,133 B2 * 10/2016 Rodgers ..... A61H 15/0092
9,550,088 B2 * 1/2017 Coompol ..... A63B 21/0722
9,616,313 B2 * 4/2017 Townsend ..... B65D 43/0206
9,839,574 B2 * 12/2017 Lawrie ..... A61H 15/00
9,889,338 B2 * 2/2018 Yu ..... A63B 21/4039
9,961,987 B1 * 5/2018 Harper ..... A45F 3/14
D822,772 S * 7/2018 Jorgenson ..... D21/662
10,137,055 B2 * 11/2018 Lawrie ..... A61H 15/0092
10,265,583 B1 * 4/2019 Zaffino ..... A63B 26/003
10,335,628 B1 * 7/2019 Scarpa ..... A63B 21/0618
2008/0090707 A1 * 4/2008 Dye ..... A61H 15/0092 482/132
2010/0274165 A1 * 10/2010 Evans ..... A61H 15/00 601/122
2012/0150082 A1 * 6/2012 Davis ..... A61H 1/0237 601/118
2012/0322633 A1 * 12/2012 Holman ..... A63B 21/4035 482/123
2013/0123078 A1 * 5/2013 Marji ..... A63B 21/055 482/139
2013/0178766 A1 * 7/2013 Abdur-Raoof ..... A61H 15/00 601/19
2013/0178768 A1 * 7/2013 Dalebout ..... A61H 15/0092 601/46
2013/0261517 A1 * 10/2013 Rodgers ..... A61H 15/00 601/121
2014/0128786 A1 * 5/2014 Ross ..... A61H 15/0092 601/118
2014/0171279 A1 * 6/2014 Justice Velasco ..... A63B 26/00 482/142
2015/0190304 A1 * 7/2015 Lawrie ..... A61H 15/00 601/118
2016/0008692 A1 * 1/2016 Townsend ..... A63B 71/0036 206/315.1
2016/0059063 A1 * 3/2016 Breibart ..... A63B 23/185 482/123
2017/0071817 A1 * 3/2017 Sanchez ..... A61H 15/0092
2017/0156479 A1 * 6/2017 Kwong ..... A45F 4/02

(56) References Cited

U.S. PATENT DOCUMENTS

| | | | | |
|---|---|---|---|---|
| 2018/0071166 | A1* | 3/2018 | Lawrie | A61H 15/0092 |
| 2018/0257832 | A1* | 9/2018 | Loeffler | B65D 85/07 |
| 2018/0326254 | A1* | 11/2018 | Earls | A63B 21/4039 |

* cited by examiner

PORTABLE MODULAR FITNESS SYSTEM

CROSS REFERENCE TO RELATED APPLICATION

This application claims priority to U.S. Provisional Patent Application Ser. No. 62/418,380 filed on Nov. 7, 2016 and entitled A HEAVY-DUTY ROLLER THAT HAS COLLAPSIBLE HANDLES COMBINED WITH A CUSTOM FITNESS MAT ATTACHED. THE ROLLER HAS BUILT IN RESISTANCE BAND(S) THAT RUN THROUGH THE MAIN COMPONENT AND IS SECURED AT THE HANDLES. THE HANDLES CAN BE DETACHED FROM THE MAIN ROLLER COMPONENT. The contents of U.S. Provisional Patent Application Ser. No. 62/418,830 are hereby incorporated in their entirety by reference.

FIELD OF THE INVENTION

Device utilized in the fitness industry, more specifically, a device that allows a fitness mat to be attached to other training accessories.

This system may be of benefit to health-conscious consumers, frequent travelers or space-saving admirers.

BACKGROUND OF THE INVENTION

The health and fitness industry has taken off in a number of ways. With the help of research and the guidance of social media, people are becoming more aware of the overall health benefits of staying in shape.

Fitness mats are a must, for a lot of health and fitness conscious people at home or at the gym. These mats can be made of PVC, TPE, cork, eco-conscious rubbers, and other materials. The mat helps create a cushion for a user's hands and feet. It can also help with traction while performing exercises.

There are many at home training accessories that go well with fitness mats but they are traditionally sold separately. These items may include small weights, stretching rollers, stretching bars, elastic resistance bands, etc. A drawback of having several accessories that go with your fitness mat can be traveling with them and storing them in confined spaces. Consumers want to be able to travel with their products and mat without the hassle of bulky accessories.

Accordingly, a need exists for attaching training accessories and a fitness mat to provide ease of transportation, storage and use.

Additionally, a need exists in the fitness industry that allows for weight, resistance and plyometric training accessories to be attached to a fitness mat for convenience, portability and storability.

BRIEF SUMMARY OF THE INVENTION

The present invention is a fitness roller that can be attached to a fitness mat in a number of different ways. This invention is useful for someone that does not have time or money for a gym membership but still wants to reach their overall fitness training goals.

The fitness mat attachment comprises an opening to secure the user's feet under the provided and removably attachable fitness roller for traction and foot security during training.

The fitness roller device of the preferred embodiment has handles that connect on each of its ends via couplers by using a locking mechanism with a suspended grommet. The handles may be hollow internally for external weight to be added, if necessary. The handles can be pushed in for compacting the device for travel or detached from the fitness roller for different exercise techniques.

The handles can be secured in place to the fitness roller's end coupler by male and female threading.

The fitness roller attachment can be comprised of weights, couplers, grommets and training accessory attachments.

BRIEF DESCRIPTION OF THE DRAWINGS

The illustrations provided are used as an example and are not limited to the drawings or photos. Like references may indicate different elements.

DETAILED DESCRIPTION OF THE INVENTION

Figure 1:
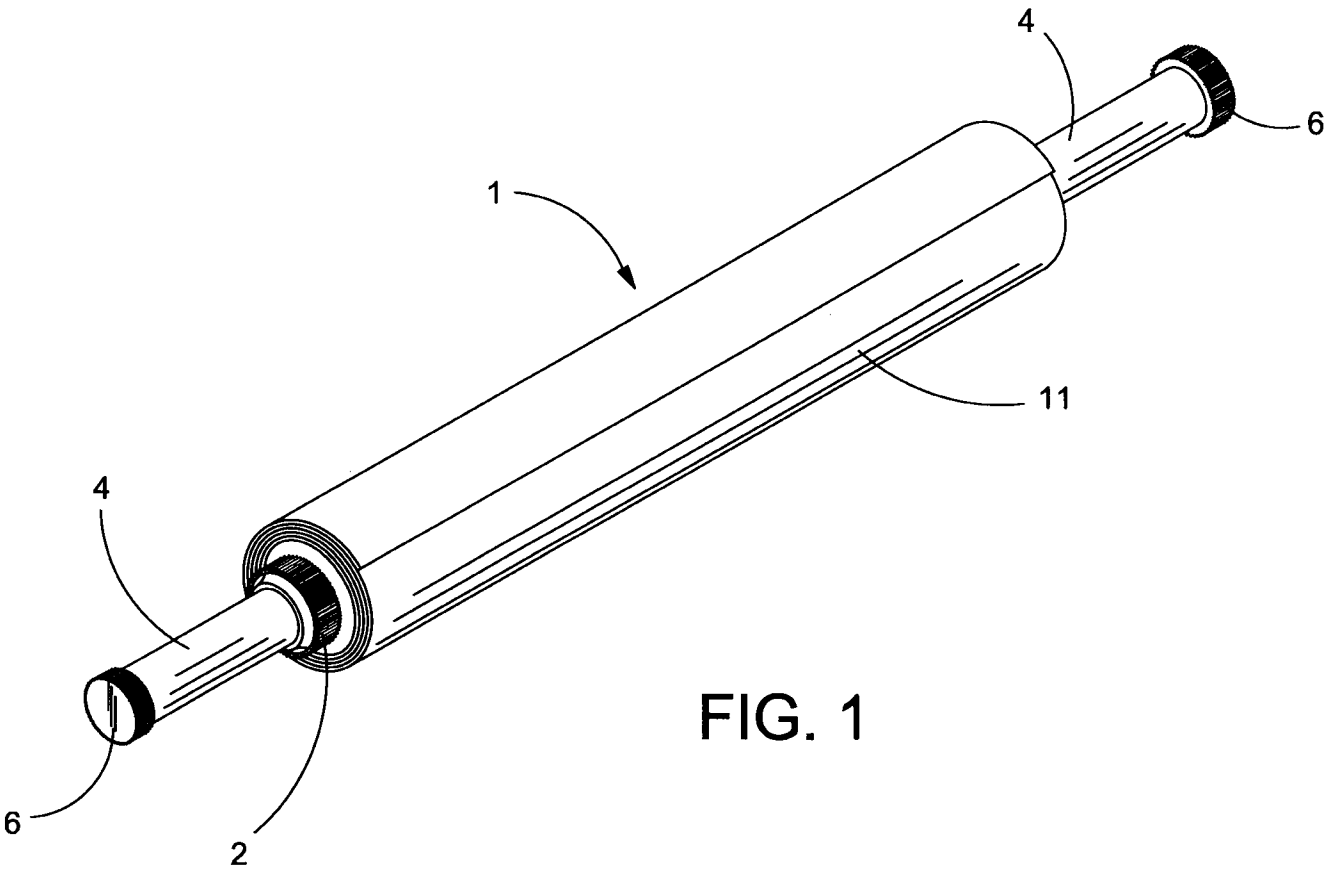
FIG. 1 is a perspective view of a fitness roller attachment and its components in its assembled state.

Various representations are shown throughout the figures hereinafter to help describe the invention. These figures are to be used to satisfy the legal applicable process but should not be interpreted as limiting. The embodiments to the invention illustrated by the figures and descriptions should not be taken as limiting.

All fundamental terminology and examples in this document should be considered basic so all parties can understand the references, materials and concepts. Any internal or external functions to the accessory device or attachments associated with the attachment system are not limited to the components shown in the drawings or descriptions.

The invention will now be described by the drawing and labels in the Figures. FIG. 1 shows a fitness roller (1) in its tubular form. The fitness roller (1) in the preferred embodiment is the same width of a standard fitness mat of 24" inches wide but is not limited to same. By doing so, it allows for a fitness mat of the preferred embodiment, when attached, to be rolled up smoothly with the fitness roller (1).

The FIG. 1 fitness roller (1) in its preferred embodiment has a max force load of 220 lbs. However, it should be appreciated by one skilled in the art that any materials now known or developed in the future may be utilized to allow more force or load to be applied to the roller (1). The fitness roller (1) and all of its attachment capabilities shown in FIGS. 3-6 can be made with many different materials. In its preferred embodiment it is comprising of Polypropylene ("PP") and/or Polyvinyl Chloride ("PVC") plastics, however other materials, such as aluminum, other metal and alloys, or any other now known or future developed materials may be used without departing from the scope of the present invention. The plastic material in the preferred embodiment of the fitness roller (1) and its components shown throughout FIG. 1, were constructed with a plastic injection molding process during manufacturing. However, it should be appreciated by one skilled in the art, that any number of manufacturing process may be utilized to manufacture the components and roller without departing from the scope of the present invention.

The fitness roller (1) in FIG. 1 may have a cover, shell or coating. The preferred embodiment attaches PVC, epa or Thermoplastic Elastomer ("TPE") rubber around the fitness roller (1). The above-listed materials are most notably used for fitness mats (11). These materials help create a cushioning effect and can be used as a massage roller for warmup and cool down phases of training when detached from the fitness mat (11) and used on its own. However, it should be appreciated by one skilled in the art that the cover, shell, or coating as discussed above is optional and may not be present or, if present, may utilize other materials without departing from the scope of the present invention.

Figure 2:
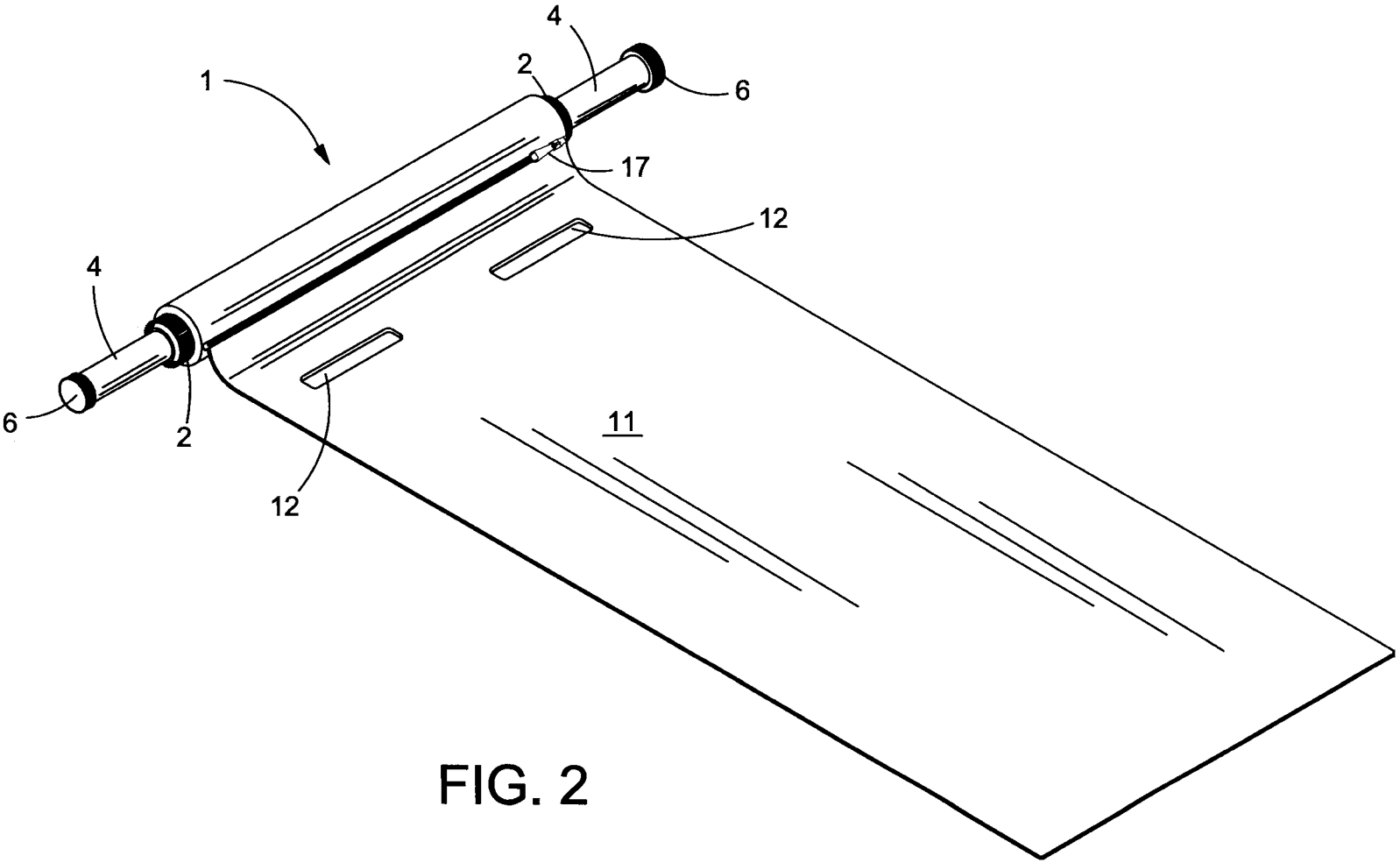
FIG. 2 is a perspective view of the fitness roller attachment and its components of FIG. 1 wherein the fitness mat is unrolled from the roller.

The fitness roller (1) in its preferred embodiment has female or male threaded coupler on each of its ends, for attachments like the handle locking coupler (2) with a suspended grommet shown in FIG. 1. The fitness roller (1) shows the weighted insert (3) may be added for more durability and strength but it is not a requirement. The insert (3) may be added for additional weight or removed to make use of the compartments for other fitness accessories. However, it should be appreciated by one skilled in the art that the fitness roller (1) and weighted inserts (3) can be utilized in any combination desired without departing from the scope of the present invention. The insert (3) may have many features, such as a built-in pulley system or hooks for elastic resistance band clips for training while clipped on the handles (4) as shown in FIG. 2.

In the preferred embodiment, each handle (4) fits into the handle locking coupler (2) on the fitness roller's (1) end coupler (2). This can be done on each of the fitness roller's (1) end couplers by locking in the handles (4), to form a large fitness training bar structure.

Figure 4:
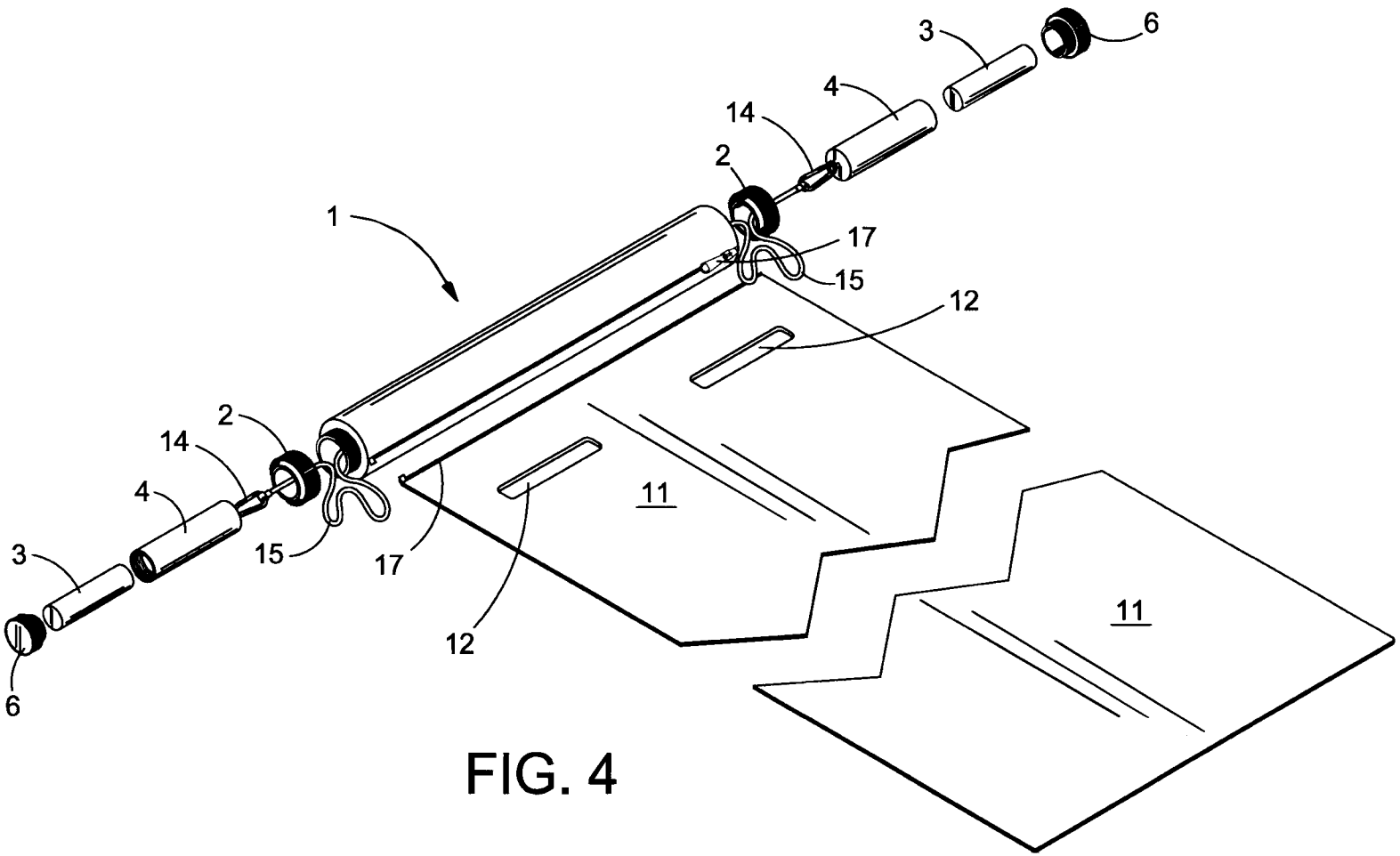
FIG. 4 is an exploded view of the fitness roller and its components of FIG. 1.
Figure 5:
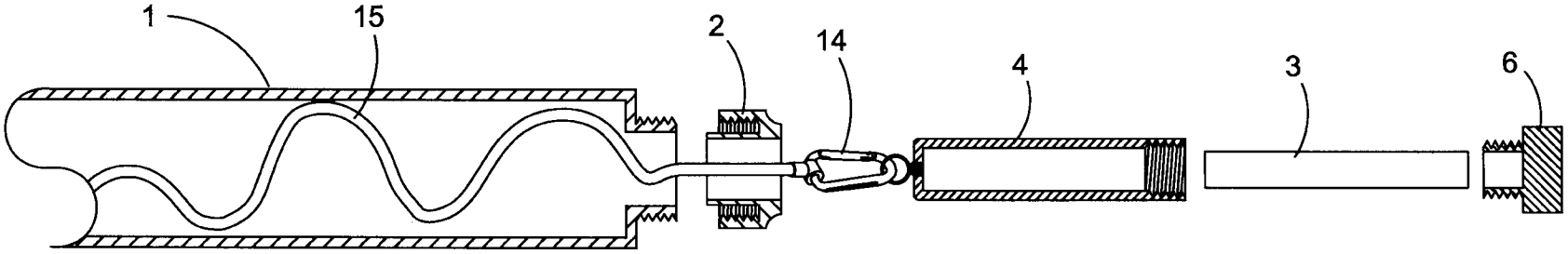
FIGS. 5-6 are cross sections of a portion of the fitness roller attachment and its components of FIG. 1.
Figure 6:
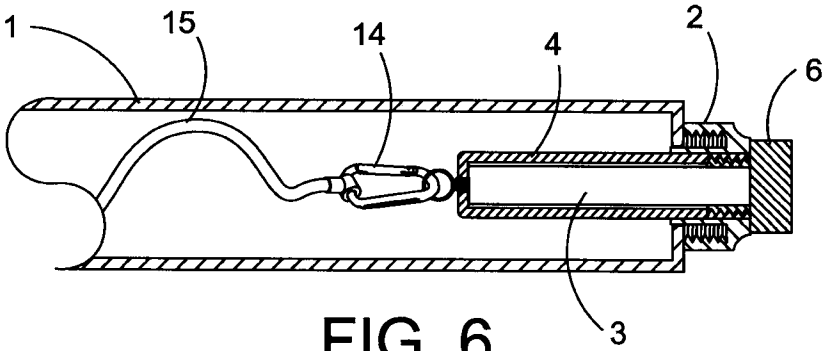

The handle (4) may be hollow for the option to add handle weights (3) as provided shown in FIGS. 4-6. The added handle weights (3) in the preferred embodiment are roughly 2 lbs. each and tube shaped in a smaller diameter compared to the hollow handle opening diameter allowing for simple insertion of the weights into the handles (4). However, it should be appreciated that any shape of handle and complimentary shaped weights may be utilized without departing from the scope of the present invention. Furthermore, it should be appreciated by one skilled in the art that any weight desired may be utilized in the handle weights (3) as well as the weighted insert (3) without departing from the scope of the present invention.

Each handle (4) has a cap (6) shown in FIG. 1, at its top end for adding accessories that add weight. The handle (4) in FIG. 1 has a closing cap (6) and its preferred embodiments are made up of male or female threads for removal. However, it should be appreciated by one skilled in the art that any releasably attachable mechanism may be utilized to connect the closing cap (6) with the handle (4) without departing from the scope of the present invention.

The handles (4) can be removed from each end of the fitness roller (1) and handle locking coupler (2) by decreasing the compression from the suspended grommet. In the preferred embodiment, an external, double threaded adapter, connects the first end of handle (4) to the first end of a second handle. Said adapter can form a larger handle for training with accessories like elastic resistance bands (15), that can be attached to said handles (4) at their bottom/second-end attachments.

The above described attachment of resistance bands (15) and the like to the handles (4) can be accomplished by the bottom/second end of each handle (4) having a fitness accessory connection mechanism. In its preferred embodiment, the bottom handle connection piece is a metal i-bolt that can swivel. However, it should be appreciated by one skilled in the art that any now known or future developed connection mechanism may be utilized without departing from the scope of the present invention. In the preferred embodiment, the elastic band (15) runs through the tubular shaped roller (1) and connect it to both handle ends to hold it in place for training as shown in FIGS. 3-6.

The whole fitness training system can be held up and placed on a custom storage stand made out of plastic. However, it should be appreciated by one skilled in the art that any material now known or developed in the future may be utilized to manufacture the stand without departing from the scope of the present invention. The system may also include a custom travel strap or sling to assist in its ease of portability. Furthermore, the fitness mat (11) of the preferred embodiment may also include complimentary located Velcro® strips to allow the Velcro® strips to connect when the fitness mat (11) is rolled up on its own or around the fitness roller of the present invention.

Figure 3:
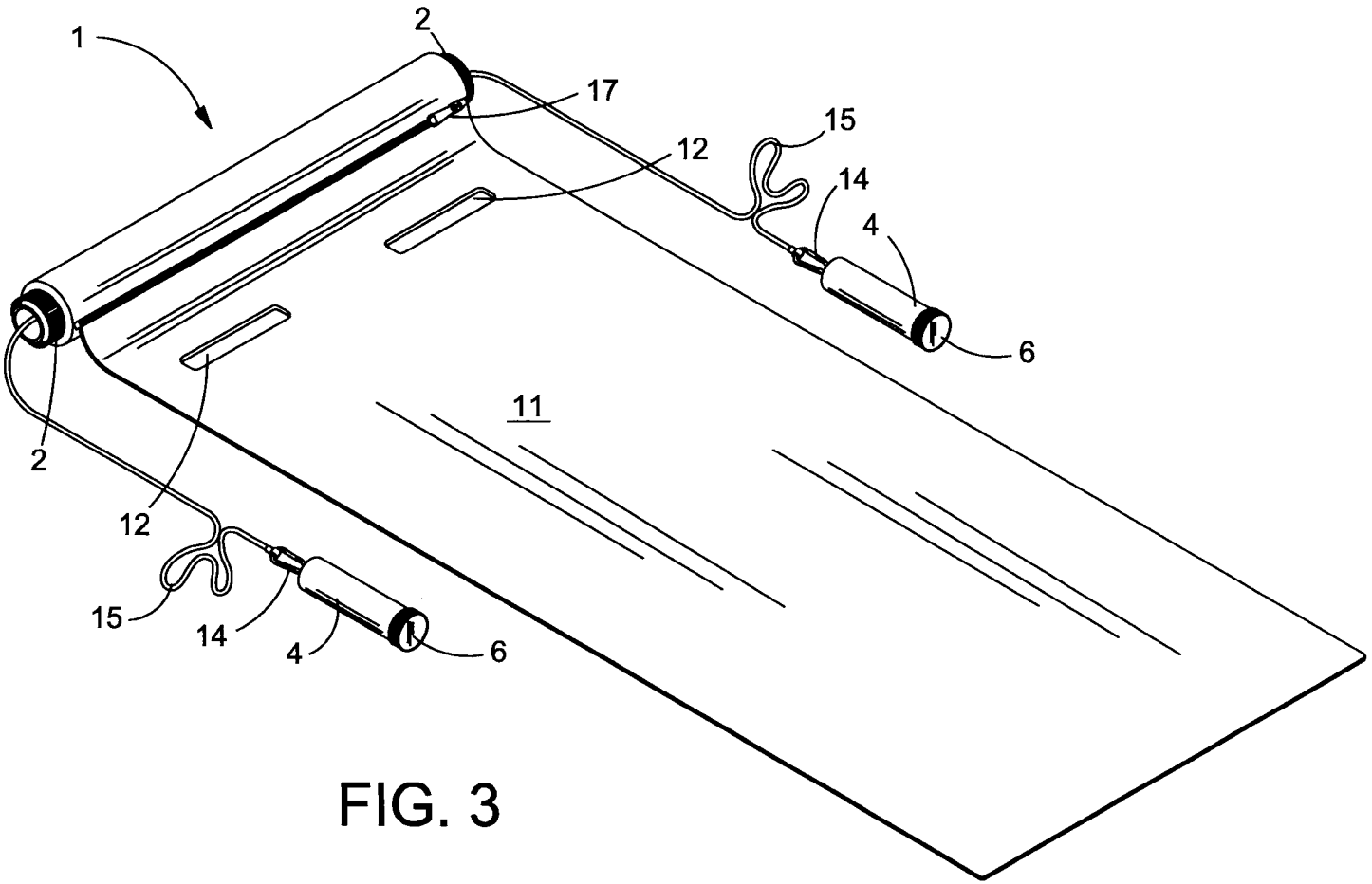
FIG. 3 is a perspective view of the fitness roller attachment and its components of FIG. 1 wherein the fitness matt is unrolled and the handles and resistance band are uncoupled for use.

Looking to FIGS. 3-5, the fitness roller attachment mechanism (9) in its preferred embodiment is blown up for a closer view. The zipper (17) in its preferred embodiment is plastic but is not limited to such a material. Plastic zippers may work best for this attachment system but the zipper can be made up of other types of material, such as metal, alloys, and/or fabric.

FIGS. 2-4 show the fitness roller (1) device wherein its attachment mechanism, illustrated as a zipper, (17) and complementary attachment mechanism of the fitness mat (11), illustrated as the other half of the zipper (17) are releasably attachable through a zipper method. However it should be appreciated by one skilled in the art that any releasably attachable mechanism that provides sufficient strength to hold the roller (1) to the fitness mat (11) during exercise may be utilized without departing form the scope of the present invention. It is contemplated different attachment mechanisms to releasably attach the fitness roller (1) to the fitness mat (11) may include sewing, Velcro®, snap fasteners, clamps, or combinations thereof. In its preferred embodiment the fitness mat (11) shown in FIG. 2-4 has two foot holes (12) built in for training and securing feet, however, it should be appreciated by one skilled in the art that the foot holes (12) are not limited to the location shown.

The handle locking coupler (2) in its preferred embodiment may include a suspended center grommet, to secure the handle by compressing when the fitness roller end couplers are tightened by male and female threading.

An alternative method shown to replace the suspended grommet uses a pin locking system for the handles. However, it should be appreciated by one skilled in the art that any releasably attachable mechanism may be utilized to connect the handles (4) and fitness roller (1) without departing from the scope of the present invention. The pin locking system, would lock the handles in by sliding it inside of the fitness roller coupler and have the capability to be unlocked by pulling the pin from the originally chosen security hole in the fitness roller end coupler. An alternative embodiment for the fitness accessory connection piece (14) at the bottom/second end of the handle (4) is shown in FIGS. 3-6. The fitness connection (14) at the bottom hole of the handle (4) shown in FIG. 3 is notched out plastic or metal. However, as discussed above, it should be appreciated by one skilled in the art that any releasably attachable connection mechanism may be utilized on the second end/bottom of the handle (4)

without departing from the scope of the present invention. The elastic resistance band (15) would slide and lock in place to the bottom the handle (4) and run through the tubular shaped fitness roller during use and/or storage.

The foregoing descriptions of various embodiments have been presented only for purposes of illustration and description. They are not intended to be exhaustive or to limit the present invention to the forms disclosed. Accordingly, many modifications and variations of the present invention are possible in light of the above teachings will be apparent to practitioners skilled in the art. Additionally, the above disclosure is not intended to limit the present invention. In the specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered, joined) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between network connections of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

What is claimed is:

1. A fitness roller comprising:

a. a tubular body;

b. a first attachment mechanism having a first male and female threaded coupler, said first male coupler having a suspended grommet on one end of said tubular body;

c. a second attachment mechanism having a second male and female threaded coupler, said second male coupler having a suspended grommet on an opposing end of said tubular body; and d. wherein tightening of said female coupler threading to said male coupler threading causes compression against said suspended grommet of said male coupler;

e. at least one removably, slidably attachable handle to removably and slidably interface with said first or second attachment mechanism, said handle comprising a first end and a second end;

f. a fitness accessory that is releasably attachable to said tubular body; and g. an elastic band connected to said handle;

h. wherein said first end of said handle is removably attachable to said handle and the body of said handle is substantially hollow to accept at least one weight member via the opening of the removably attachable first end.

2. The fitness roller of claim 1 wherein said first end of said handle is connectable to a first end of second handle via a first handle connection mechanism to form a larger handle member and wherein said second end of said handle comprises a second handle attachment mechanism.

3. The fitness roller of claim 2 wherein said second handle attachment mechanism of said second end of said handle is connected to said at least one elastic-band.

4. The fitness roller of claim 3 wherein said tubular body of said roller is substantially hollow allowing said handle or said elastic band to be fully or partially stored within said tubular body.

5. The fitness roller of claim 1 wherein said fitness accessory is a fitness mat.

6. The fitness roller of claim 5 wherein said fitness mat further comprises an opening to accept a user's foot.

7. A fitness roller comprising:

a. a single tubular body;

b. a first attachment mechanism having a first male and female threaded coupler on one end of said tubular body;

c. a second attachment mechanism having a second male and female threaded coupler on an opposing end of said tubular body;

d. at least one removably attachable handle that removably interfaces with said first or second attachment mechanism, said handle comprising a first end and a second end; and e. a fitness accessory that is releasably attachable to said roller tubular body;

f. wherein said first end of said handle is removably attachable to said handle and the body of said handle is substantially hollow to accept at least one weight member via the opening of the removably attachable first end.

8. The fitness roller of claim 7 wherein said first and second male couplers each further comprise a suspended grommet wherein tightening of said first and second female coupler threading to said first and second male coupler threading, respectively, causes compression against said suspended grommet of said male coupler.

9. The fitness roller of claim 7 wherein said handle is slidably attachable to said first or second attachment mechanism of said roller.

10. The fitness roller of claim 7 wherein said first end of said handle is connectable to a first end of a second handle via a first handle attachment mechanism to form a larger handle member.

11. The fitness roller of claim 7 wherein said second end of said handle comprises a second handle attachment mechanism.

12. The fitness roller of claim 11 wherein said second handle attachment mechanism of said second end of said handle is connected to at least one elastic band.

13. The fitness roller of claim 7 wherein said fitness accessory is a fitness mat.

14. The fitness roller of claim 13 wherein said fitness mat further comprises an opening to accept a user's foot.

15. A fitness roller comprising:

a. a single tubular body;

b. a first attachment mechanism having a first male and female threaded coupler on one end of said tubular body;

c. a second attachment mechanism having a second male and female threaded coupler on an opposing end of said tubular body;

d. at least one removably attachable handle that removably interfaces with said first or second attachment mechanism, said handle comprising a first end and a second end, said second end of said handle comprising a second handle attachment mechanism connected to at least one elastic band; and e. a fitness accessory that is releasably attachable to said roller tubular body;

f. wherein said tubular body of said roller is substantially hollow allowing said handle or said elastic band to be fully or partially stored within said tubular body.

16. A fitness system comprising:

a. a roller comprising a tubular body that is substantially hollow;

b. a first attachment mechanism having a first male and female threaded coupler on one end of said tubular body;

c. a second attachment mechanism having a first male and female threaded coupler on an opposing end of said tubular body; and d. wherein said first and second male couplers each further comprises a suspended grommet;

e. wherein tightening of said first and second female coupler threading to said first and second male coupler threading, respectively, causes compression against said suspended grommet of said male coupler;

f. at least one removably, slidably attachable handle to removably and slidably interface with said first or second attachment mechanism said handle having a first end and a second end;

g. wherein said first end of said handle is removably attachable to said handle and the body of said handle is substantially hollow to accept at least one weight member via the opening of said removably attachable first end h. wherein said first end of said handle is connectable to a first end of a second handle to form a larger handle and wherein said second end of said handle comprises a second handle attachment mechanism;

i. wherein said second handle attachment mechanism of said second end of said handle is connected to at least one elastic band;

j. wherein at least one of said handle or said elastic band may be fully or partially stored within said hollow, tubular body; and k. a fitness mat that is releasably attachable to said roller tubular body.

17. The fitness roller of claim 16 wherein said fitness mat further comprises an opening to accept a user's foot.

18. A fitness roller comprising:

a single tubular body having a first end and a second end;

a first handle releasably attachable to said tubular body first end;

a second handle releasably attachable to said tubular body second end;

at least one elastic band configured for resistance exercise between at least one of said first and second handles and at least one of said other handle and said tubular body;

a fitness mat connected to said tubular body and having a storage position and a use position wherein said fitness mat rolls around said tubular body in said storage position and wherein the longitudinal axes of said tubular body and said fitness mat are at an angle to each other in said use position.

19. The fitness roller of claim 18 wherein said fitness mat is releasably attachable to said single tubular body via an attachment mechanism selected from the group consisting of:

a. zipper;

b. hook and loop fastener;

c. snap connector;

d. sewing;

e. clamps; and f. combinations thereof.

20. The fitness roller of claim 18 wherein at least one of said first and second handles is substantially hollow to accept at least one weight member.

* * * * *